United States Patent [19]

Choi et al.

[11] 4,265,570

[45] May 5, 1981

[54] MINE ROOF CONTROL

[75] Inventors: Dai S. Choi, Ponca City, Okla.; Hilmar A. von Schonfeldt, Lexington, Ky.

[73] Assignee: Conoco, Inc. (formerly Continental Oil Company), Ponca City, Okla.

[21] Appl. No.: 44,817

[22] Filed: Jun. 1, 1979

[51] Int. Cl.[3] ..... E21D 19/00

[52] U.S. Cl. ..... 405/258; 299/16

[58] Field of Search ..... 405/258, 259, 52, 132, 405/303; 299/16

[56] References Cited

U.S. PATENT DOCUMENTS

| | | | |
|---|---|---|---|
| 999,000 | 7/1911 | Trippe | 299/16 X |
| 2,867,426 | 1/1959 | Dowie | 299/16 |
| 3,026,096 | 3/1962 | Love | 405/52 X |
| 3,068,654 | 12/1962 | Warren | 405/132 X |
| 3,097,830 | 7/1963 | Love et al. | 299/19 X |
| 3,111,306 | 11/1963 | Love et al. | 405/259 X |
| 3,673,807 | 7/1972 | Serata | 405/258 |
| 3,988,037 | 10/1976 | Denisart et al. | 299/16 |
| 4,084,384 | 4/1978 | Serata | 405/132 |

*Primary Examiner*—Dennis L. Taylor

*Attorney, Agent, or Firm*—Richard W. Collins

[57] ABSTRACT

A method for controlling a mine roof by drilling one or more boreholes into the roof formation to a location adjacent the top of a mineral seam and hydraulically fracturing the roof formation to enlarge the natural caving zone or to induce orderly caving of a mine roof.

13 Claims, 2 Drawing Figures

MINE ROOF CONTROL

BACKGROUND OF THE INVENTION

1. Field of the Invention

This invention relates to underground mining operations, and more particulary to a method for controlling a mine roof by inducing controlled roof caving over mined out areas.

2. Description of the Prior Art

Methods for controlling caving of mined out areas are described in U.S. Pat. Nos. 3,402,968 and 3,673,807.

A method utilizing hydraulic fracturing between boreholes to provide communication between boreholes in a solution mining process is described in U.S. Pat. No. 3,058,730.

Methods for controlling caving during mining of trona are described in U.S. Pat. Nos. 3,026,096; 3,097,830 and 3,111,306.

None of the above-noted patents suggests protecting a mine entryway by inducing additional roof caving by hydraulic fracturing of the mine roof formation.

SUMMARY OF THE INVENTION

According to the present invention, one or more boreholes are drilled through a mine roof formation, either before, during or after mining depending on the particular roof formation and the results desired. The boreholes may be drilled from the surface to a point adjacent the top of the mineral seam, or may be drilled from a mined out area upwardly through the mine roof formation to an appropriate height. A fracturing fluid is injected at formation fracturing pressure into a portion of the borehole extending from adjacent the top of the mineral seam to a height of from 20 to 400 meters above the top of the seam. The resulting fractures cause the caving zone to be greater than would normally occur, thus decreasing the load on support pillars at the edge of the mined out area. In the case where boreholes are drilled into a mine roof comprised of a stiff formation such as limestone or sandstone over an area to be mined out and the fracturing precedes mining out the area, the fractures facilitate orderly caving behind the mining operation, thus decreasing the chances of sudden roof failure which can occur when stiff roof formations are involved.

It is an object of the invention to provide an increased caving zone over a mined out area.

It is a further object to enhance the occurrance of orderly caving of stiff roof formations to prevent sudden roof failures.

These and other objects and advantages are obtained by the present invention, as will be apparent from the following detailed description of the preferred embodiments.

DESCRIPTION OF THE PREFERRED EMBODIMENTS

Figure 1:
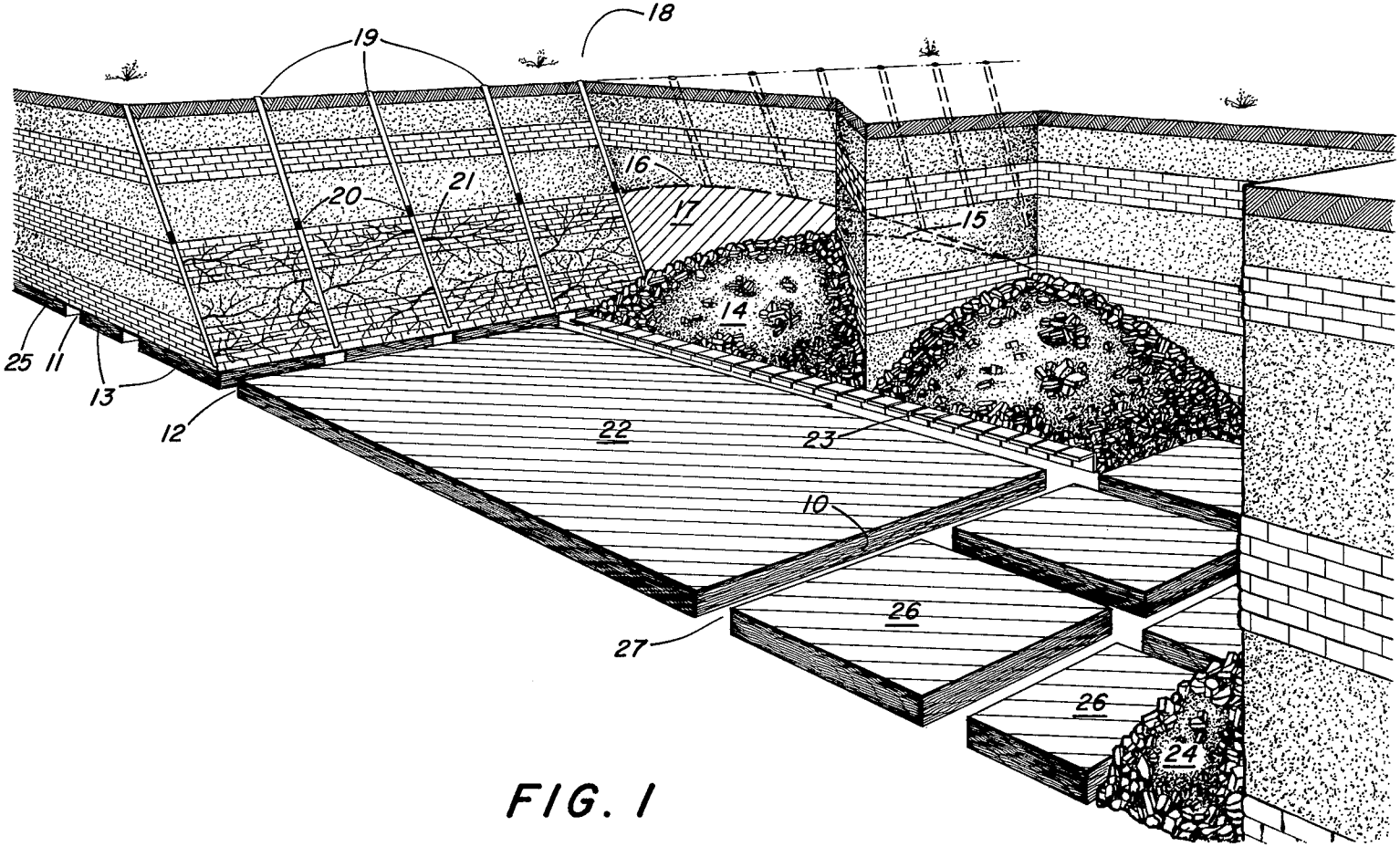
FIG. 1 is a perspective cut away view illustrating the relationship of the boreholes to an area being mined by longwall mining techniques.

FIG. 1 illustrates one version of longwall mining in which panel 22 of mineral seam 10 is being mined. A row of roof supports 23 provides protection against caving for the men and equipment cutting and removing material from mineral seam 10. A previously mined area 24 is shown at the right of FIG. 1, and panel 25 at the upper left of FIG. 1 is to be mined after mining of panel 22 is completed. Support pillars 26 between mined area 24 and panel 22 protect entryway 27 between pillars 26 and panel 22. Entryway 27 may serve as an air return and as an escape route for miners. Entryway 11 will serve the same purpose when panel 25 is mined. Without the process of this invention, entryway 11 would be subject to high loads from the uncaved overburden, resulting in high maintenance and potentially dangerous operation. It is desirable to reduce the load on entryway 11 as much as possible without increasing the size of support pillars 13. As will be appreciated, support pillars represent unrecoverable mineral, and it is desired to keep them as small as possible so long as safety is not compromised.

In the most preferred embodiment of the invention, an entryway such as entryway 11 is protected by increasing the caving zone over the mined out area resulting from mining out panel 22. The mineral seam may be any material, but the process is particularly useful when the mineral seam is coal.

A natural caving zone 14 is shown extending from the floor of the mined out area to arcuate boundary 15 (FIGS. 1 and 2) in the mine roof formation. The shape and extent of the natural caving zone 14 results in very high loads on pillars 13, requiring excessive maintenance around the entryway 11.

The load on pillars 13 can, in accordance with this invention, be reduced by creating a fracture plane above panel edge 12 which in turn encourages the caved in zone to increase from the area bounded by line 15 to the area bounded by line 16. The portion of the load carried by pillars 13 is thus reduced by an amount proportional to the size of the induced caving zone 17 between boundary lines 15 and 16. The load from area 17 is concentrated at the top of panel edge 12 unless it is caused to cave in by the method of the invention. After caving, the load from area 17 is primarily carried by the floor of the mined out area.

Figure 2:
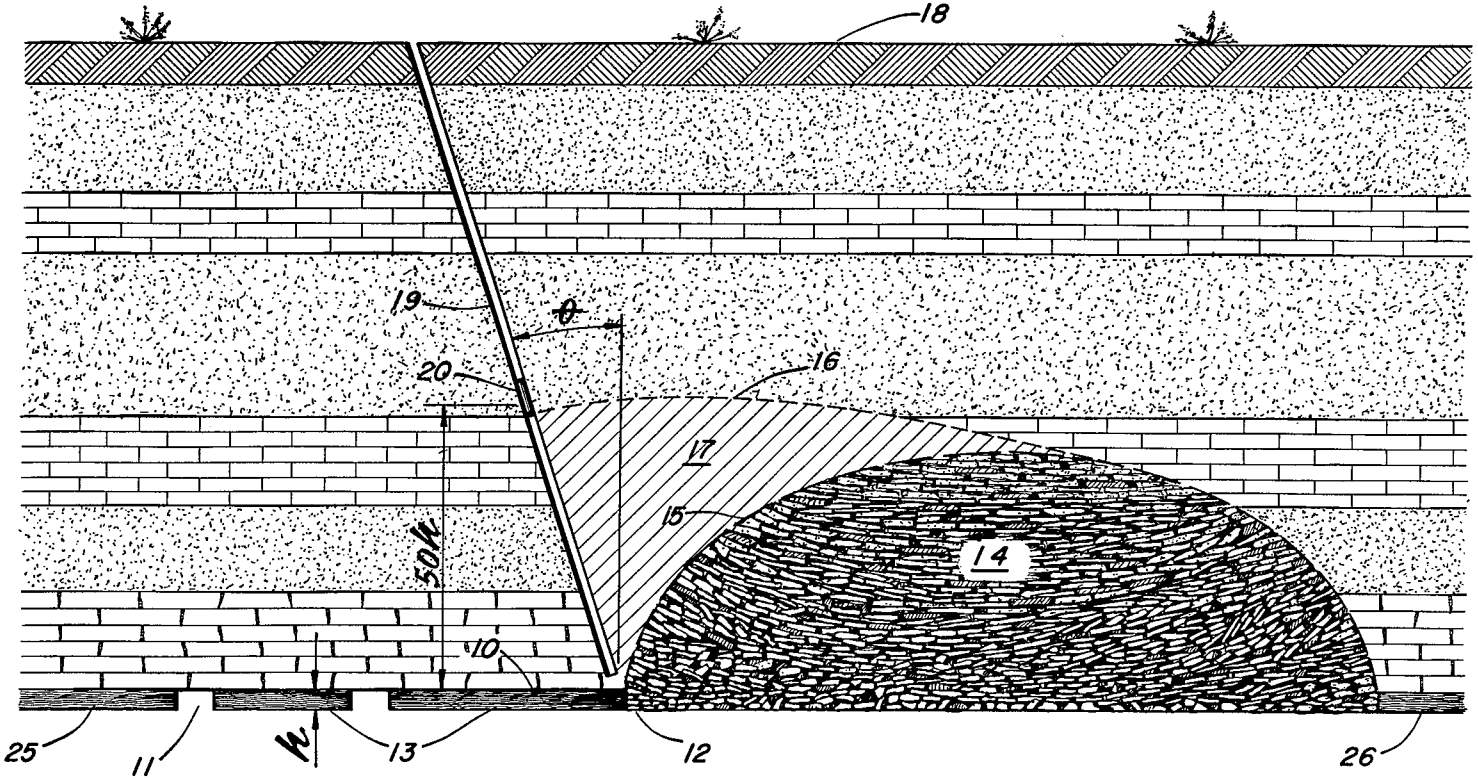
FIG. 2 is a side view showing the enhanced caving zone provided by the invention.

In order to cause the portion of the mine roof formation between boundary lines 15 and 16 to cave, a plurality of boreholes 19 are drilled from the surface 18 to a point adjacent to and just above the top of panel edge 12. As shown in FIGS. 1 and 2, the boreholes extend from the surface. However, the boreholes could alternatively be drilled upwardly from within the mined out area.

Boreholes 19 are inclined from the vertical at an angle $\theta$ away from the mined out area. This angle $\theta$ may be as much as 30°, but preferably is about 18° or less. Packers 20 are set in boreholes 19 at a position of from 20 to 200 meters above the top of the mined out seam. The mined out seam typically has a uniform height of from 1.5 to 3 meters, and the packed off portion of boreholes 19 is preferably from 30 to 70 times the height of the mined out seam. In many cases, a packed off portion of about 50 times the height of the mined out seam is preferred.

After packers 20 are established in boreholes 19, fracturing fluid is injected at fracturing pressure into the packed off portion of boreholes 19. It will be apparent that the portion of boreholes 19 below packers 20 will be exposed to the fracturing fluid, creating a network of fractures 21 extending generally along the plane defined by boreholes 19. The fractures facilitate caving of the zone between boundary layers 15 and 16 as a result of stresses in the roof formation, either naturally occurring or induced by the mining operation.

The fracturing fluid can be water, or may be water or other liquid with or without additives such as viscosity-increasing agents. The fracturing pressure of the roof formation depends on factors such as depth of the formation and type of formation. Normally, a pressure of from 100 to 1000 kg/cm$^2$ is sufficient. The fracturing may be done before, during or after the mining of panel 22 but must be done before panel 25 is mined in order to protect entryway 11.

It will be apparent that the process as described above and illustrated in the drawings is somewhat idealized. In actual practice, the natural caving zone as well as the enlarged caving zone will be irregular, and the fractures will extend to some extent in directions other than along the plane defined by the boreholes. However, the principles of the invention are believed to be clear from the foregoing description.

In accordance with another embodiment of the invention, one or more boreholes are drilled into a stiff mine roof formation such as limestone or sandstone before development of the area under the formation. The boreholes are subjected to hydraulic fracturing, and when the area is developed the roof caves in an orderly manner due to the preliminary fracturing. Without the preliminary fracturing step, a stiff mine roof is subject to sudden collapse, with potentially catastrophic results. Without the process of this invention, the area under a stiff roof formation might only be mineable by techniques which limit the recovery of the mineral being mined.

The method of this invention will now be described for a hypothetical operation. A longwall mining operation includes an entryway 11 protected by support pillars 13. Prior to mining of the area bounded by panel edge 12, a series of boreholes 19 are drilled from the surface to a point adjacent the panel edge 12 and above the mineral seam to be mined. Boreholes 19 are packed off at a point about 50 times the height of the mineral seam and fracturing fluid injected at formation fracturing pressure. Fractures 21 extending along the plane defined by the boreholes are generated. When the area bounded by panel edge 12 is mined out, the caving zone extends to the area beneath boundary line 16 due to the fractures previously formed and the stresses induced by the mining. The increased caving zone above the natural caving zone is supported by the floor of the mined out area, and the loads on pillars 13 are less than the loads that would exist if only natural caving occurred.

The invention has been described primarily with respect to longwall mining, with some mention of use to facilitate caving of a stiff roof formation. However, the invention is applicable to mining operations generally in situations where enhanced orderly caving of a mine roof is desired.

We claim:

1. A method of controlling a mine roof comprising:

(a) drilling at least one borehole through a mine roof formation from the surface to a point adjacent a mineral seam, said borehole being at an angle of from 0 to 30 degrees to a vertical reference axis;

(b) sealing off a portion of said borehole from a vertical height of from 20 to 400 meters above the top of said mineral seam to said point adjacent said seam; and (c) injecting fluid into the sealed off portion of said borehole at a pressure sufficient to create fractures in the mine roof formation along the sealed off portion of said borehole whereby the caving zone over a mined out portion of said mineral seam is greater than the natural caving zone over said portion.

2. The method of claim 1 wherein a plurality of parallel boreholes are utilized.

3. The method of claim 1 wherein said mineral seam is a coal seam having a substantially uniform height and includes a mined-out area.

4. The method of claim 3 wherein the vertical height of the sealed off portion of the borehole is from 30 to 70 times the height of said mined-out seam.

5. The method of claim 4 wherein the vertical height of the sealed off portion of the borehole is about 50 times the height of the mined-out seam.

6. The method of claim 4 wherein said mineral seam is a coal seam being developed by long wall mining.

7. The method of claim 6 wherein said borehole extends to a point adjacent an edge of a mined-out area.

8. The method of claim 7 wherein a plurality of parallel boreholes adjacent an edge of a mined-out area are utilized.

9. The method of claim 8 wherein said boreholes are inclined at an angle of about 18° away from the mined-out area and the fracture plane is generated by injection of water at a pressure of from 100 to 1000 kg/cm$^2$.

10. The method of claim 9 wherein said boreholes are parallel to a mine entryway, and a caved-in zone larger than the natural caved-in zone resulting from mining is created.

11. In a long wall mining operation in which an entryway extends parallel to an edge of an area being mined and in which an entryway support system comprising a series of pillars extends between said edge and said entryway, the improvement wherein the caving zone of said area being mined is increased by the method comprising:

(a) drilling at least one borehole to a point adjacent said edge of said area being mined, said borehole being at an angle of from 0 to 30 degrees away from a vertical plane through said edge and toward said entryway;

(b) sealing off a portion of said borehole from a vertical height of from 20 to 400 meters above said point to said point; and (c) injecting fluid into the sealed off portion of said borehole at a pressure sufficient to create a fracture plane whereby the caving zone above the area being mined is increased toward said opening and the load on said opening support system is reduced.

12. The method of claim 11 wherein a plurality of parallel boreholes are utilized.

13. The method of claim 12 wherein the vertical height of the sealed off portion of the boreholes is from 30 to 70 times the height of the seam being mined out.

* * * * *